United States Patent [19]

Schleicher

[11] Patent Number: 4,964,342

[45] Date of Patent: Oct. 23, 1990

[54] PROPULSION MECHANISM FOR A SUBCALIBER PROJECTILE

[75] Inventor: Ulrich Schleicher, Hersbruck, Fed. Rep. of Germany

[73] Assignee: Diehl GmbH & Co., Nuremberg, Fed. Rep. of Germany

[21] Appl. No.: 446,998

[22] Filed: Dec. 6, 1989

[30] Foreign Application Priority Data

Dec. 24, 1988 [IT] Italy ..... 3843968

[51] Int. Cl.[5] ..... F42B 14/06

[52] U.S. Cl. ..... 102/521

[58] Field of Search ..... 102/520–523

[56] References Cited

U.S. PATENT DOCUMENTS

Re. 1,787 10/1864 Smith .
3,100,448 8/1963 Hablutzel .
3,834,314 9/1974 Young .
4,671,182 6/1987 Zierler et al. .
4,867,067 9/1989 Becker et al. .

FOREIGN PATENT DOCUMENTS 784548 2/1972 Belgium .
0029107 5/1981 European Pat. Off. .
0152492 8/1985 European Pat. Off. .
0190548 8/1986 European Pat. Off. .
3021914 9/1983 Fed. Rep. of Germany .
131034 8/1919 United Kingdom .

OTHER PUBLICATIONS

European Search Report.

*Primary Examiner*—Charles T. Jordan
*Assistant Examiner*—Richard W. Wendtland
*Attorney, Agent, or Firm*—Scully, Scott Murphy & Presser

[57] ABSTRACT

A propulsion mechanism or sabot for a subcaliber projectile, in which the mechanism is constructed segmented, and which includes a carrier component defining a form-fitted zone between itself and the projectile, a front part which is connected with the carrier component which is constructed with an air pocket, a rearward positioning or adjusting part defining the projectile caliber which is connected to the carrier component, and an outer part which is arranged intermediate the front part and the rearward positioning part.

7 Claims, 1 Drawing Sheet

FIG. 1
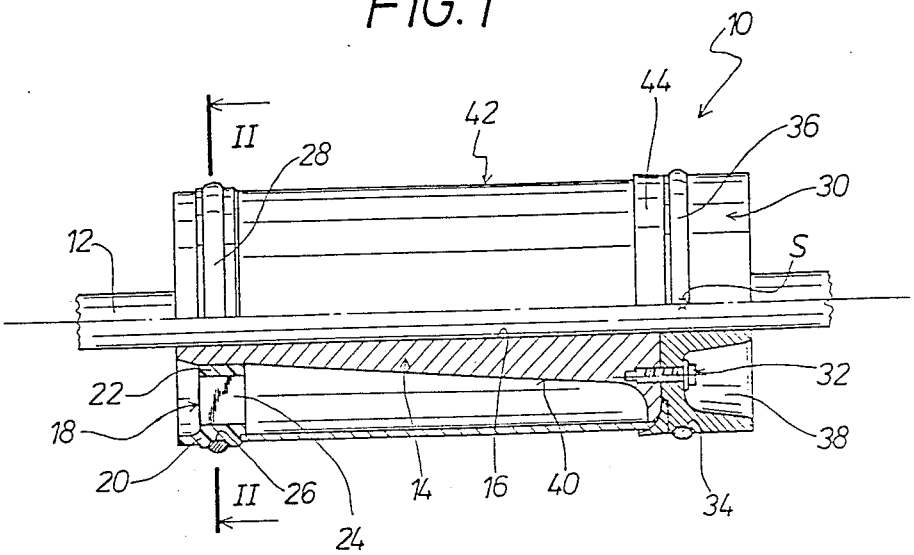
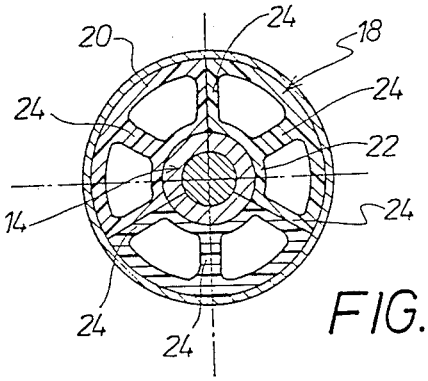
FIG. 2

PROPULSION MECHANISM FOR A SUBCALIBER PROJECTILE

BACKGROUND OF THE INVENTION

1. Field of the Invention

The present invention relates to a propulsion mechanism or sabot for a subcaliber projectile, in which the mechanism is constructed segmented, and which includes a carrier component defining a form-fitted zone between itself and the projectile, a front part of which projectile is connected with the carrier component, the latter of which is constructed with an air pocket, a rearward positioning or adjusting part which is connected to the carrier component, and an outer part which is arranged intermediate the front part and the rearward positioning part.

2. Discussion of the Prior Art

A propulsion mechanism or sabot of the type referred to hereinabove is known from the disclosure of German Pat. No. 36 25 730 A1. In this propulsion mechanism, the outer constituent includes a fibrous component which assumes tensile stresses, and which is connected with the carrier component. The fibrous component possesses individual parts which extend intermediate a front and a rear positioning or adjusting region. This propulsion mechanism or sabot consists of a multiplicity of individual parts whereby, especially because of the individual constituents of the fibrous component, there is encountered a considerable demand on assembling work during the manufacture of such a sabot or propulsion mechanism. For the support from the rear thereof, this propulsion mechanism can be provided with radial projections.

SUMMARY OF THE INVENTION

Accordingly, it is an object of the present invention to provide a propulsion mechanism or sabot of the above-mentioned type, which is of a simple construction and which possesses relatively few individual constituents so that, as a consequence thereof, its manufacture is comparatively simple in nature and which during its movement through a firing tube or barrel will not be compressed, but have its aerodynamic properties improved.

The foregoing object is inventively attained in that the carrier component, in comparison with the front part, has a relatively lower weight, and wherein the rear positioning or adjusting part, in comparison with the front part; in essence, relative to the carrier component, has a low weight and is constituted from a damping or muffling material. As a result of such a construction for the sabot or propulsion mechanism, the center of gravity thereof is shifted from its middle region towards the nose end, in view of which there is obtained a so-called pulling sabot or propulsion mechanism. The rearward, or in effect, the tail end guidance of the propulsion mechanism is hereby afforded through the relatively lightweight rear positioning or adjusting part, which can be constituted from a plastic material or from a composite material such as a laminate. Thereby, a material of adequate strength which possesses good damping or muffling properties can be readily employed. For instance, the rearward positioning part can be constituted of nylon.

The front part which is connected with the carrier component is preferably constituted from a material which is of a heavier specific density than the material of the carrier component. Thus, for example, the carrier component can be constituted from an aluminum alloy. The connection between the front part and the carrier component can be effectuated, for instance, through the intermediary of screw elements. The connection of the rear positioning part with the carrier component can be carried out by means of glueing, spray molding, or the like.

The rear positioning part preferably possesses two concentric annular shoulders or collars which are interconnected through connecting ribs or radial webs. A positioning part of this kind can be implemented in a simple manner, and is readily mechanically rigidly connectible with the carrier component.

The outer shoulder on the rear positioning part is preferably encompassed by a retaining ring which defines the caliber of the sabot or propulsion mechanism. This retaining ring is preferably constituted from a material which is protective of the weapon barrel.

The front part of the propulsion mechanism can be encompassed by a second retaining ring which also defines the caliber of the sabot or propulsion mechanism. The second retaining ring can be constituted from the same material as that of the retaining ring which is mounted on the rear positioning part.

The outer constituent of the propulsion mechanism is preferably formed in the shape of a tubular sleeve. The tubular outer constituent serves for the protection of the weapon barrel and currently for purposes of imparting a stabilizing action.

When discussion is set forth herein regarding a sabot or propulsion mechanism which is constructed segmented, then it must be understood that the individual parts thereof, such as the carrier component, the rear positioning part and the front part are each respectively assembled from at least two segments, which are preferably formed to be equally-sized.

Inasmuch as a so-called pulling sabot or propulsion mechanism passing through a weapon barrel evidences improved traveling characteristics in comparison with a pressing or pushing propulsion mechanism, it is possible to simply support the propulsion mechanism at its tail end by means of the rear positioning part, the latter of which can be sized to be comparatively lightly dimensioned and resultingly low in weight. However, it is of importance that this rear positioning part produces good damping or muffling properties. Achieved as a result thereof is a so-called traveling-charge effect. For the rear positioning part, a polyamide material has been found to be advantageous. Through the damping material of the rear positioning part, during the firing, it becomes possible to absorb any possibly encountered transverse or lateral shocks. Moreover, the dead weight constituent of the sabot or propulsion mechanism is relatively low, without adversely influencing its loading capacity during the firing of the projectile.

BRIEF DESCRIPTION OF THE DRAWINGS

Further details, features and advantages of the invention may now be readily ascertained from the following description of an exemplary embodiment of the inventive sabot or propulsion mechanism, taken in conjunction with the accompanying drawings; in which:

FIG. 1 illustrates a longitudinal halfsectioned view of a sabot or propulsion mechanism with a partially illustrated subcaliber projectile; and FIG. 2 illustrates a sectional view taken along line II—II in FIG. 1.

DETAILED DESCRIPTION

FIG. 1 illustrates a half-sectioned longitudinal view through a sabot or propulsion mechanism 10, and through a partially represented projectile 12. The propulsion mechanism 10 possesses a carrier component 14 which forms a close-fitted zone 16 between itself and the projectile 12. For instance, the carrier component 14 may be constituted from an aluminum alloy. A positioning part 18 is connected with the tail end of the carrier component 14; for instance, through adhesion or glueing. The positioning part 18 may be constituted from a polyamide.

As can be also ascertained from FIG. 2, the positioning part 18 includes an outer shoulder or flange-like collar 20 and an inner similar shoulder 22, which are arranged coaxially and interconnected through the intermediary of connecting ribs or webs 24. From FIG. 2 there is can also be ascertained that the positioning part 18 is divided into segments. Correspondingly, the carrier component 14 is also segmented. The rear positioning part 18 is provided at its outer circumference with a peripheral groove 26, in which there is positioned a retaining ring 28.

Connected with the carrier component 14 is a front positioning part 30, for example, through screw elements 32, whereby the front part 30, which is segmented in the same manner as the carrier component 14, and which is constituted from a material which is of a heavier specific density than that of the carrier component 14, so that the center of gravity S (as shown in FIG. 1) is shifted from the middle region of the propulsion mechanism 10 so far towards the front end, that there is produced a so-called pulling sabot or propulsion mechanism 10. The front part 30 is formed at its outer circumference with an encompassing groove 34, in which there is arranged a second retaining ring 36. The retaining rings 28 and 36 define the caliber of the sabot propulsion mechanism 10. The front part 30 is formed with an air pocket 38 which serves for the controlled utilization of an oncoming air stream subsequent to exiting from a weapon barrel. The carrier component 14 is configured in such a manner that there is obtained a gas pressure-pickup surface 40 which during the firing; in essence, during passage through the weapon barrel, is subjected to the action of gases from the propellant.

Extending between the front part 30 and the rear positioning part 18 is an outer component 42, the latter of which is formed as a tubular sleeve and at its front or nose end is retained by a ring element 44. This ring element 44 can pertain to a sealing element, which is similar to, or instead of the second retaining ring 36, can be provided for defining the caliber of the sabot or propulsion mechanism 10.

What is claimed is:

1. Propulsion mechanism for a subcaliber projectile, said propulsion mechanism being axially segmented about the circumference of said projectile and including a carrier component having a form-fitted contacting zone with said projectile, a front part being connected with the leading end of said carrier component and having forwardly facing air pocket formed therein; an axially segmented rear positioning part being connected with and extending about a rearward portion of said carrier component, said rear positioning part having axial through-apertures formed therein, and a sleevelike outer part extending between the front part and the rear positioning part so as to encompass said carrier component, said carrier component having a lower weight than said front part, said rear positioning part having a lower weight than said front part and said carrier component and being constituted from a damping material, said front part which is connected with the carrier component consisting of a material which is of a heavier specific density than the material of the carrier component.

2. A propulsion mechanism as claimed in claim 1, wherein said rear positioning part is constituted from a plastic material.

3. A propulsion mechanism as claimed in claim 1, wherein the rear positioning part is constituted from a composite material.

4. A propulsion mechanism as claimed in claim 1, wherein the rear positioning part includes two concentric flange-like shoulders, and radial connecting webs connecting said shoulders.

5. A propulsion mechanism as claimed in claim 4, wherein the outer shoulder of said rear positioning part is encompassed by a retaining ring defining the caliber of said propulsion mechanism.

6. A propulsion mechanism as claimed in claim 5, wherein said front part is encompassed by a second retaining ring defining the caliber of sad propulsion mechanism.

7. A propulsion mechanism as claimed in claim 1, wherein the outer part consists of a tubular sleeve.

* * * * *